US011820123B2

(12) United States Patent
Caspari et al.

(10) Patent No.: US 11,820,123 B2
(45) Date of Patent: Nov. 21, 2023

(54) DOCTOR BLADE SYSTEM

(71) Applicant: BOBST BIELEFELD GMBH, Bielefeld (DE)

(72) Inventors: Volker Caspari, Detmold (DE); Johannes Schmidt, Bielefeld (DE)

(73) Assignee: BOBST BIELEFELD GMBH, Bielefeld (DE)

( * ) Notice: Subject to any disclaimer, the term of this patent is extended or adjusted under 35 U.S.C. 154(b) by 0 days.

(21) Appl. No.: 17/759,061

(22) PCT Filed: Jan. 6, 2021

(86) PCT No.: PCT/EP2021/050109
§ 371 (c)(1),
(2) Date: Jul. 19, 2022

(87) PCT Pub. No.: WO2021/148248
PCT Pub. Date: Jul. 29, 2021

(65) Prior Publication Data

US 2023/0045510 A1 Feb. 9, 2023

(30) Foreign Application Priority Data

Jan. 22, 2020 (EP) ..... 20020032

(51) Int. Cl.
*B41F 31/04* (2006.01)
*B41F 35/00* (2006.01)

(52) U.S. Cl.
CPC ..... *B41F 31/04* (2013.01); *B41F 35/008* (2013.01)

(58) Field of Classification Search
CPC ..... B41F 9/10; B41F 9/1036; B41F 31/04; B41F 35/008; B41F 31/027; B41F 5/24
See application file for complete search history.

(56) References Cited

U.S. PATENT DOCUMENTS

| | | | | |
|---|---|---|---|---|
| 5,406,887 | A | 4/1995 | Hertel et al. | |
| 5,826,509 | A * | 10/1998 | Deneka | B41F 31/027 118/259 |
| 6,089,159 | A * | 7/2000 | Gorter | B41F 31/027 101/154 |
| 6,637,330 | B1 | 10/2003 | Nordby et al. | |
| 2004/0045463 | A1 | 3/2004 | Pertile | |
| 2014/0261032 | A1 | 9/2014 | Deneka | |
| 2018/0117899 | A1 | 5/2018 | Kita et al. | |

(Continued)

FOREIGN PATENT DOCUMENTS

| | | | |
|---|---|---|---|
| CN | 2160982 | Y | 4/1994 |
| CN | 101722901 | A | 6/2010 |
| CN | 104960328 | A | 10/2015 |

(Continued)

*Primary Examiner* — Matthew G Marini
*Assistant Examiner* — Leo T Hinze
(74) *Attorney, Agent, or Firm* — Bookoff McAndrews, PLLC

(57) ABSTRACT

A doctor blade system of a printing machine comprises a doctor blade (12), a blade support (14) and a clamping element (16), wherein the doctor blade (12) is arranged at a contact surface (24) on a front side (20) of the blade support (14) and pressed against the contact surface (24) by a pressing area (34) of the clamping element (16). The clamping element (16) has a bearing surface (40) arranged at a backside (27) of the blade support (14).

12 Claims, 2 Drawing Sheets

(56) References Cited

U.S. PATENT DOCUMENTS

2018/0236639 A1 8/2018 Short et al.

FOREIGN PATENT DOCUMENTS

| | | | |
|---|---|---|---|
| CN | 107175886 | A | 9/2017 |
| CN | 107521429 | A | 12/2017 |
| DE | 102017200610 | | 8/2017 |
| EP | 2374617 | A1 | 10/2011 |
| JP | H02113942 | A | 4/1990 |
| WO | 0078548 | A1 | 12/2000 |
| WO | 2008152022 | A1 | 12/2008 |

* cited by examiner

Fig. 1
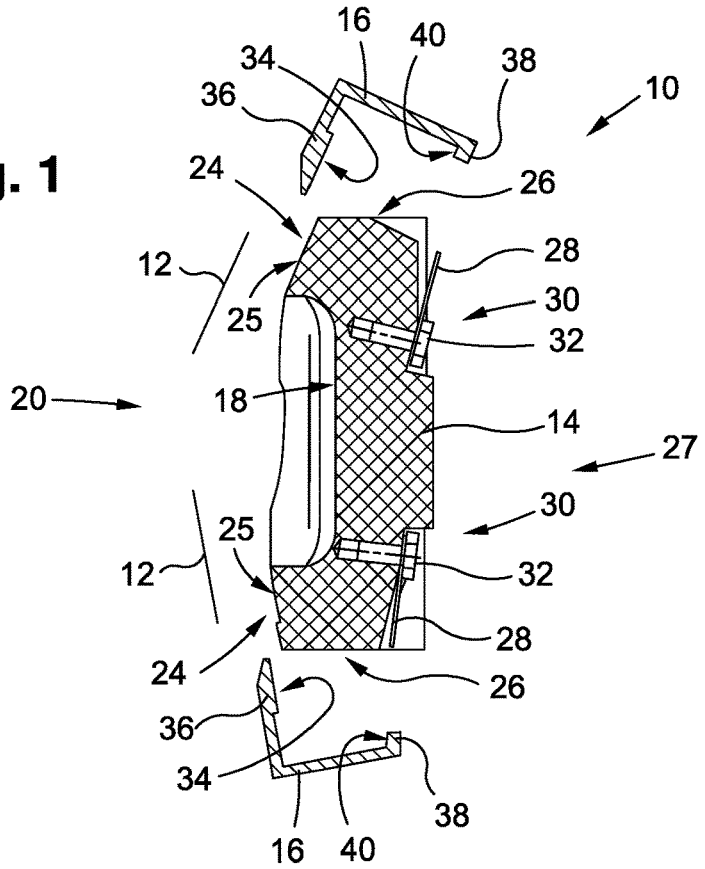
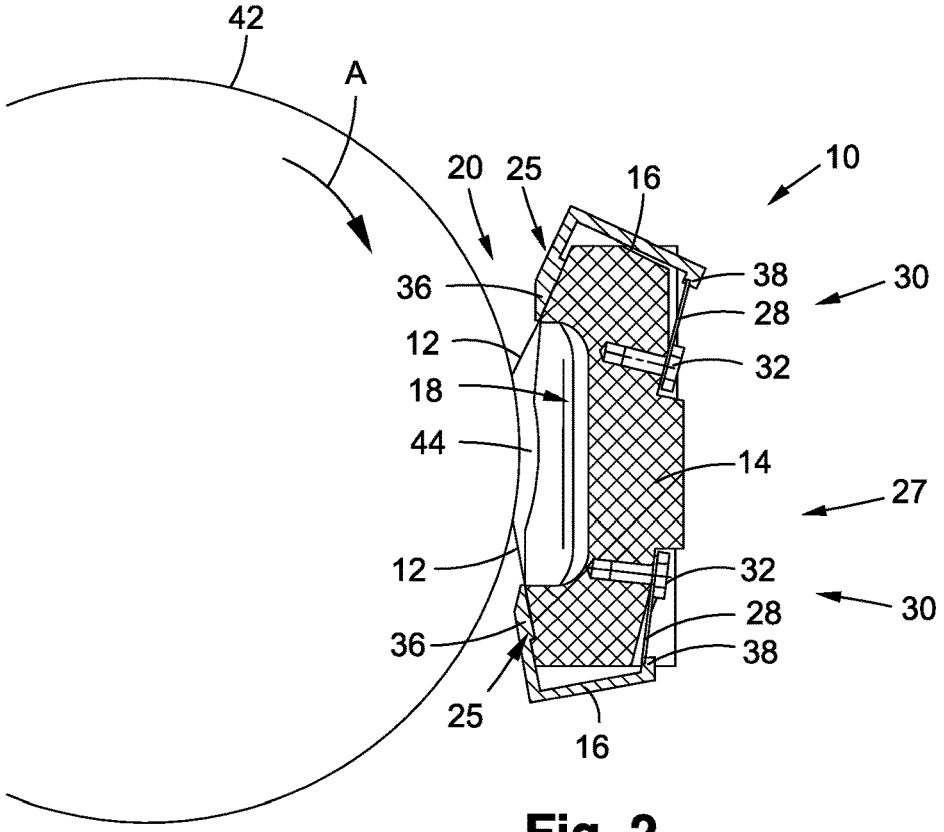
Fig. 2

DOCTOR BLADE SYSTEM

CROSS-REFERENCE TO RELATED APPLICATION(S)

This patent application is a National Stage Application under 35 U.S.C § 371 of International Patent Application No. PCT/EP2021/050109, filed on Jan. 6, 2021, which claims priority to European Patent Application No. 20020032.7, filed on Jan. 22, 2020, the entireties of which are incorporated herein by reference.

TECHNICAL FIELD OF THE INVENTION

The invention relates to a doctor blade system of a printing machine.

BACKGROUND OF THE INVENTION

In printing machines, inks are applied on a printing cylinder from which the ink is applied in a subsequent step to a substrate. Typically, several printing cylinders are used, wherein the ink is first transferred from an ink reservoir to a first printing cylinder from which the ink is further transferred to the actual printing cylinder that is in contact with the substrate.

Flexographic printing units use so-called anilox rolls as printing cylinders for taking up the ink. Anilox rolls have engravings on their surface in which the ink is collected. Doctor blades are used to scrape off excess ink from the surface of the anilox roll.

However, as the anilox roll is constantly turning, the doctor blades wear down over time during operation of the printing machine due to friction between the doctor blades and the rotating anilox roll. Additionally, the ink scraped off by the doctor blades can at least partially adhere on the surface of the doctor blades. Therefore, the doctor blades have to be exchanged and/or cleaned after some time. Additionally, the doctor blades must be securely locked in their position during operation of the printing machine. For this reason, mechanisms for locking and releasing the doctor blades are known in the art.

The object of the invention is to provide a doctor blade system which can easily be cleaned and assembled.

SUMMARY OF THE INVENTION

The object of the invention is solved by a doctor blade system of a printing machine, comprising a doctor blade, a blade support and a clamping element, wherein the doctor blade is arranged at a contact surface on a front side of the blade support and pressed against the contact surface by a pressing area of the clamping element. Further, the clamping element has a bearing surface arranged at and pressing against a backside of the blade support.

According to the invention, the doctor blade is secured on the blade support by the clamping element to ensure a reliable alignment of the doctor blade.

At the same time, the clamping element extends around the blade support and presses against the backside of the blade support. In this way, the clamping element is secured in place and locking the doctor blade in its position.

With other words, the clamping element presses with the contact surface towards the front side of the blade support and with a counter-directed force towards the backside of the blade support.

Further, the clamping element is especially releasable from the blade support in a non-destructive manner to allow for easy removal of the clamping element when disassembling the doctor blade system, e.g. for cleaning.

As only the contact surface of the clamping element needs to be arranged at the front side of the blade support, the shape of the blade support can be simplified. This allows using flat and large surfaces on the front side of the blade support which are easier to clean.

With other words, the blade support does not need to have a multitude of contours and/or steps which could hinder cleaning of the blade support.

Further, the design of the blade support can be simplified and less components are necessary so that the risk of damaging some of the components of the doctor blade system is reduced.

The clamping element can press directly against the backside of the blade support or indirectly by means of further components of the doctor blade system.

The clamping element especially extends over a side surface of the blade support. In this way, the clamping element can easily be accessed for assembling and/or de-assembling the doctor blade system.

The printing machine can especially be a flexographic printing unit.

To further prevent the doctor blade from shifting and/or slipping on the front side of the blade support, the contact surface can be part of a recess of the blade support.

The recess can have dimensions which match the size of the doctor blade, especially the width of the doctor blade. This allows placing the doctor blade in the recess with low tolerances regarding the orientation of the doctor blade during assembly of the doctor blade system.

The pressing area of the clamping element can be part of a protrusion which engages into the recess of the blade support. Therefore, the clamping element is mechanically locked in the recess and cannot shift in its position, allowing for an especially secure fit of the clamping element when it presses against the doctor blade.

The interaction of the clamping element, especially of the protrusion of the clamping element, with the recess provides for a secure fit of the clamping element. Preferably, the protrusion of the clamping element is pressed against the recess by the tension of the clamping element itself in an assembled state of the doctor blade system.

In one embodiment, the surface of the pressing area of the clamping element is parallel to the extension direction of the doctor blade. In this way, the pressure applied by the clamping element on the doctor blade is perpendicular to the extension direction of the doctor blade, thereby pressing the doctor blade effectively against the contact surface of the chamber body.

The surface of the pressing area is especially a flat surface for increasing the size of the pressing area which is in contact with the doctor blade.

When the doctor blade is placed in a recess of the blade support, the pressure on the doctor blade can be aligned with the recess in this embodiment.

The pressing area preferably extends over the full length of the recess. With other words, the clamping element presses against the blade support over the full length of the recess, maximizing the area over which pressure is applied on the doctor blade and ensuring that the doctor blade is sufficiently locked in its position.

The pressing area can also apply a force in a direction with an inclined angle to the contact surface, as long as a secure fit of the doctor blade is ensured.

The clamping element can be a spring clip. Spring clips are easy to mount on the blade support, cheap and can apply sufficient force on both the front side and the backside of the blade support at the same time.

In another embodiment, the bearing surface of the clamping element is interacting with a retaining mechanism at the backside of the blade support.

The retaining mechanism further secures the position of the clamping element, preventing the clamping element from shifting and/or wobbling.

Further, the retaining mechanism can be configured to exert a counter-directed force on the bearing surface. However, the counter-directed force must be small enough that the clamping element is still securely locked.

The retaining mechanism allows to easily unfasten the clamping element if the clamping element should be removed, e.g. when the doctor blade system needs to be cleaned.

The bearing surface can be a surface of a lug of the clamping element. With other words, the clamping element can have an angled and/or curved section in which the retaining mechanism engages. This allows for an especially secure interaction between the clamping element and the retaining mechanism.

Preferably, the retaining mechanism comprises a sheet metal spring or a compression spring. Such springs are cheap and can be easily mounted on the backside of the chamber body.

The bearing surface of the clamping element can also be interacting with the retaining mechanism by means of a transfer element arranged between the retaining mechanism and the bearing surface of the clamping element.

The transfer element is especially an additional sheet metal.

The transfer element allows customizing the cross-section between the retaining mechanism and the bearing surface. This allows e.g. transmitting a force applied by the retaining mechanism on a small area of the bearing surface by means of a larger area of the transfer element or vice versa.

By pressing on the retaining mechanism and/or the transfer element in a direction essentially parallel to the force applied by the bearing surface of the clamping element, the counter-directional force applied by the retaining mechanism can be overcome for releasing the clamping element when de-assembling the doctor blade system.

In one embodiment, the doctor blade system can have two doctor blades which are secured by a clamping element.

Preferably, the doctor blade system has as many clamping elements as doctor blades. Each of the clamping elements can be a clamping element as described before.

In this embodiment, the blade support can have several contact surfaces and/or retraining mechanisms as described before, wherein the clamping elements each interact with one of the contact surfaces and/or retaining mechanisms.

In general, the doctor blade system can have more than two doctor blades with each being secured by a clamping element.

The doctor blade system can especially be a chamber doctor blade system. In this case, the blade support can be a chamber body of the chamber doctor blade system. This allows forming an ink reservoir between the blade support, the doctor blades and a printing cylinder against which the blade support and the doctor blades are pressed.

In such an embodiment, ink will rapidly collect on the doctor blades and the front side of the blade support, thereby creating the need for regular cleaning of the doctor blades and of the blade support. The doctor blade system according to the invention makes de-assembling and re-assembling of the components especially simple.

BRIEF DESCRIPTION OF THE DRAWINGS

Further advantages and features will become apparent from the following description of the invention and from the appended figures which show non-limiting exemplary embodiments of the invention and in which:

FIG. 1 shows a partial explosive view of a cut through a first embodiment of a doctor blade system according to the invention;

FIG. 2 shows the assembled doctor blade system of FIG. 1 in a printing machine.

DETAILED DESCRIPTION OF PREFERRED EMBODIMENTS

Figure 3:
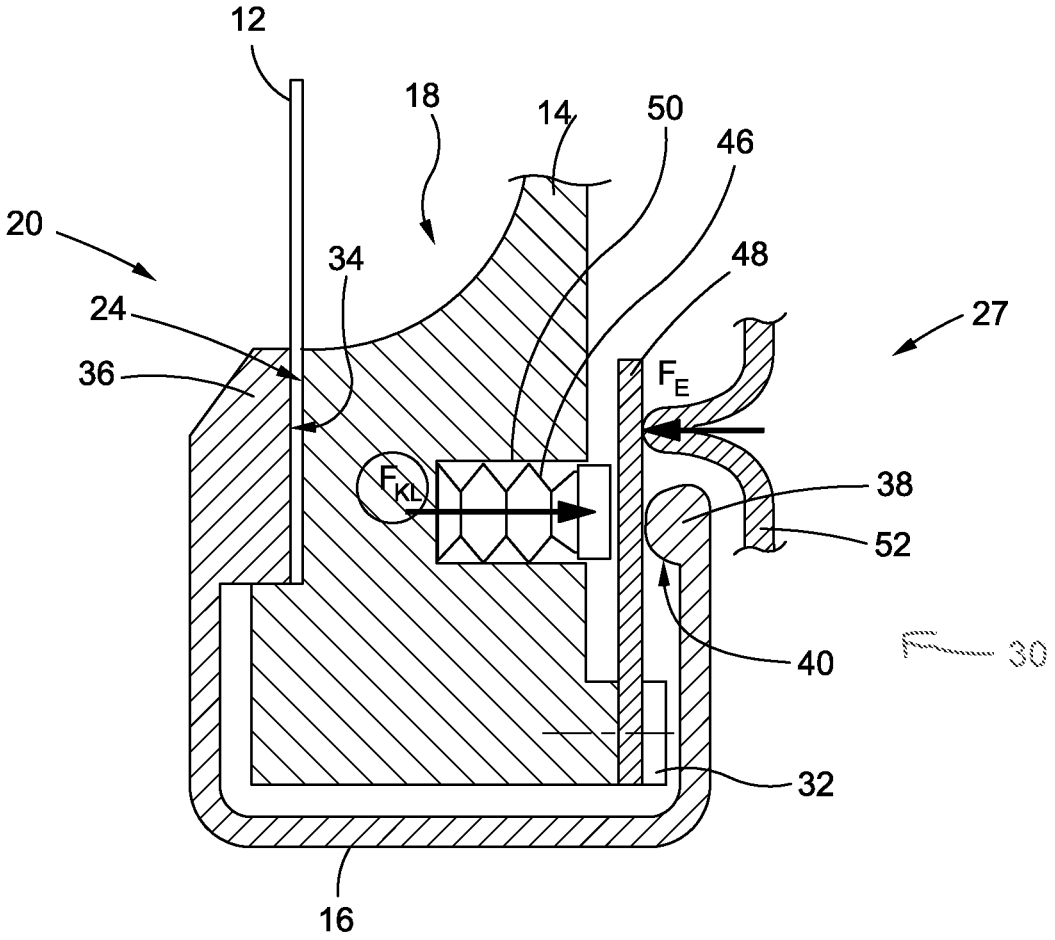
FIG. 3 a detail of a cut through a second embodiment of the doctor blade system according to the invention.

FIG. 1 shows a partial explosive view of a cut through a doctor blade system 10 according to the invention.

The doctor blade system 10 comprises two doctor blades 12, a blade support 14 and two clamping elements 16.

The blade support 14 has a cavity 18 at a front side 20.

The blade support 14 has two contact surfaces 24 into which the doctor blades 12 are placed when the doctor blade system 10 is assembled.

The contact surfaces 24 are part of recesses 25, which form a step towards side surfaces 26 of the blade support 14.

At a backside 27, the blade support 14 has two retaining mechanisms 30. The retaining mechanisms 30 comprise sheet metal springs 28, which are fixed to the blade support 14 by screws 32.

In the shown embodiment, the clamping elements 16 are spring clips of a size suitable to extend from the front side 20 over the side surface 26 to the backside 27.

The clamping elements 16 each have a pressing area 34 on a protrusion 36, which in the shown embodiment are formed in a first end section of the clamping element 16. The protrusion 36 can engage in the recesses 25 on the front side 20 of the blade support 14.

Further, the clamping elements 16 each have a lug 38, which in the shown embodiment are formed in a second end section of the clamping element 16.

To assemble the doctor blade system 10, the doctor blades 12 are each placed into one of the recesses 25 on the front side 20 of the blade support 14, so that the doctor blades 12 are in contact with the stop of the respective recess 25.

Then, the protrusion 36 of the clamping element 16 is placed on top of the respective doctor blade 12 and the lug 38 is clamped on the sheet metal spring 28 of the retaining mechanism 30.

With other words, the first end section of the clamping element 16 is placed on the front side 20 and the second end section is used to fasten the clamping element 16 around the blade support 14.

Due to the tension of the clamping element 16, the pressing area 34 of the protrusion 36 presses on the doctor blade 12 so that the doctor blade 12 is pressed against the contact surface 24 of the blade support 14.

At the same time, the lug 38 arranged at the backside 27 of the blade support presses with a bearing surface 40 on the sheet metal spring 28.

Therefore, the clamping elements 16 is securely fixed in its position around the blade support 14.

In FIG. 2, the assembled doctor blade system 10 is shown as it is used in a printing machine.

The doctor blade system 10 is pressed against a printing cylinder 42 of the printing machine. The printing cylinder 42 is an anilox roll in the shown embodiment. Accordingly, the printing machine is a flexographic printing unit.

The anilox roll rotates in the direction illustrated in FIG. 2 by the arrow A and takes up ink from an ink reservoir 44 into cells engraved in the surface of the anilox roll during its rotation.

The ink reservoir 44 is formed between the anilox roll, the doctor blades 12 and the surface of the cavity 18 of the blade support 14. Accordingly, the doctor blade system 10 is a chamber doctor blade system in the shown embodiment.

The blade support 14 can have an ink inlet and ink outlet (not shown) which can supply and remove ink from the ink reservoir 44, respectively.

The doctor blades 12 are used to scrape of excess ink from the surface of the anilox roll.

As is best seen in FIG. 2, the protrusions 36 of the clamping elements 16 extend over the full length of the recesses 25 on the front side 20 of the blade support 14.

Further, the pressing areas 34 on the protrusions 36 are parallel to the respective contact surfaces 24 of the recesses. Accordingly, the clamping element 16 is pressing the respective doctor blade 12 onto the contact surface 24 with a force perpendicular to the contact surface 24.

The contact surfaces 24 are inclined relative to the printing cylinder 42, wherein the inclination angles differ between the two contact surfaces 24 to allow for a desired contact angle between the respective doctor blade 12 and the printing cylinder 42.

During operation of the printing machine, the doctor blades 12 wear down due to the friction between the rotating printing cylinder 42 and the doctor blades 12. In addition, excess ink can adhere to the doctor blades 12.

Therefore, the doctor blade system 10 needs to be deassembled after some time to exchange the doctor blades 12 and/or to clean the doctor blades 12 and the blade support 14.

For this, an operator (not shown) of the printing machine can press on the sheet metal spring 28 so that the sheet metal spring 28 bends towards the blade support 14.

As a result, the lug 38 is not any more supported on the retaining mechanism 30 and the clamping element 16 can easily be removed so that the doctor blades 12 can be exchanged and/or the blade support 14, especially the cavity 18, can be cleaned.

The embodiment shown in FIGS. 1 and 2 comprise two doctor blades 12. In principle, the doctor blade system 10 could also have a single or more than two doctor blades 12. In this case, the doctor blade system 10 preferably has a clamping element 16 and a retaining mechanism 30 for each of the doctor blades 12.

In FIG. 3, a second embodiment of the doctor blade system 10 is shown, wherein only part of the doctor blade system 10 is shown, analogue to the lower half of the doctor blade system 10 as shown in FIG. 2.

The second embodiment essentially corresponds to the first embodiment so that only differences will be discussed below. Same parts are denoted with the same reference numerals and reference is given to the explanations given above.

In the second embodiment, a different retaining mechanism 30 is used, which comprises a compression spring 46 acting on a transfer element 48 with a counter-directed force $F_{KL}$.

The compression spring 46 is arranged in a groove 50 on the backside 27 of the blade support 14.

The transfer element 48 interacts with the bearing surface 40 of the lug 38 of the clamping element 16.

To release the clamping element 16, an operator can press manually or with a tool 52 on the transfer element 48 with a force $F_E$ sufficient to compress the compression spring 46.

The invention claimed is:

1. A doctor blade system of a printing machine, the doctor blade system comprising:

a doctor blade;

a blade support; and a clamping element, wherein the doctor blade is arranged at a contact surface on a front side of the blade support and pressed against the contact surface by a pressing area of the clamping element, and wherein the clamping element has a bearing surface arranged at and pressing against a spring fixed to a backside of the blade support, wherein the bearing surface extends from a wall connecting the bearing surface to the contact surface and toward the backside of the blade support.

2. The doctor blade system according to claim 1, wherein the contact surface is part of a recess of the blade support.

3. The doctor blade system according to claim 2, wherein the pressing area of the clamping element is part of a protrusion which engages into the recess.

4. The doctor blade system according to claim 1, wherein a surface of the pressing area is parallel to an extension direction of the doctor blade.

5. The doctor blade system according to claim 1, wherein the bearing surface of the clamping element interacts with the spring at the backside of the blade support to provide a tension force to fasten the clamping element around the blade support.

6. The doctor blade system according to claim 5, wherein the spring comprises a sheet metal spring or a compression spring.

7. The doctor blade system according to claim 5, wherein the bearing surface of the clamping element is interacting with the spring by a transfer element arranged between the spring and the bearing surface of the clamping element.

8. The doctor blade system according to claim 1, wherein the bearing surface is a surface of a lug of the clamping element.

9. The doctor blade system according to claim 1, wherein the doctor blade system has two doctor blades which are each secured by a clamping element.

10. The doctor blade system according to claim 9, wherein the doctor blade system is a chamber doctor blade system.

11. The doctor blade system according to claim 1, further comprising:

a compression spring arranged in a groove on the backside of the blade support, and contacting an opposite side of the spring from the bearing surface.

12. A doctor blade system of a printing machine, the doctor blade system comprising:

a doctor blade;

a blade support including a recess on a front side of the blade support, the recess including a contact surface;

a spring fixed to a back side of the blade support; and a clamping element including a pressing area on a protrusion of the clamping element, a bearing surface, and a connection portion connecting the pressing area and the bearing surface, wherein the doctor blade is pressed against the contact surface by the pressing area of the clamping element, the protrusion extending toward the recess, and wherein the bearing surface presses against the spring, the bearing surface extending from the connection portion toward the back side of the blade support.

* * * * *